United States Patent [19]

Takada et al.

[11] 4,376,430

[45] Mar. 15, 1983

[54] AIR-FUEL MIXTURE RATIO CONTROL DEVICE

[75] Inventors: Shigetaka Takada, Ohbu; Yukihiro Watanabe, Nagoya, both of Japan

[73] Assignee: Aisan Industry Co., Ltd., Aichi, Japan

[21] Appl. No.: 282,290

[22] Filed: Jul. 10, 1981

[30] Foreign Application Priority Data

Jul. 25, 1980 [JP] Japan ..... 55-102802

[51] Int. Cl.[3] ..... F02B 33/00

[52] U.S. Cl. ..... 123/438; 123/440; 123/361

[58] Field of Search ..... 123/438, 489, 440, 361

[56] References Cited

U.S. PATENT DOCUMENTS 2,389,797 11/1945 McNeil et al. ..... 123/440

3,875,907 4/1975 Wessel ..... 123/440

*Primary Examiner*—Ronald B. Cox

[57] ABSTRACT

An air-fuel ratio control device for controlling the air-fuel ratio of a mixture to be supplied into an internal combustion engine. The device has a control circuit adapted to produce, in accordance with the offset of the output of an oxygen sensor in the exhaust system of the engine from a reference value corresponding to the desired air-fuel ratio, a control signal for making the air-fuel ratio coincide with the command air-fuel ratio. The device further has a mixture supplying means including means for adjusting the air-fuel ratio in accordance with the control signal. The air-fuel ratio adjusting means includes an actuator incorporating a step motor adapted to change the opening area of fuel passage or air bleed passage of a carburetor. The control circuit has means for temporarily stopping the step motor for a predetermined time length before the stepping speed or the stepping direction of the motor is changed, to assure the correct operation of the step motor and, hence, a precise control of the air-fuel ratio.

8 Claims, 7 Drawing Figures

AIR-FUEL MIXTURE RATIO CONTROL DEVICE

BACKGROUND OF THE INVENTION

1. Field of the Invention

The present invention relates to an air-fuel mixture ratio control device adapted to control the air-fuel ratio of mixture in accordance with a signal derived from an exhaust gas sensor to maintain the air-fuel ratio at a desired level.

2. Description of the Prior Art

FIG. 1 exemplarily shows an arrangement of conventional air-fuel ratio control system. A carburetor 2 disposed at the upstream side of the engine body 1 is provided with a pick-up port 3 for bleed air for controlling main fuel system and a pick-up port 4 of bleed air for controlling slow fuel system. An oxygen sensor 6 is disposed at the upstream side of a tertiary catalyst 7 and is adapted to deliver a signal to a control circuit 9 which in turn produces a control signal for actuating an actuator 8. A reference numeral 5 designates an air cleaner, while a reference numeral 10 denotes a battery. A cooling water sensor is designated at a reference numeral 11. The actuator 8 is adapted to adjust the amounts of bleed air at the pick-up ports 3,4 thereby to vary and adjust the air-fuel ratio. The actuator is usually constituted by a step motor adapted to vary the areas of openings of the air bleed passages. A certain time length is required from the formation of the mixture in the carburetor to the arrival of the exhaust gas at the exhaust gas sensor via the step of combustion in the engine. This time length is determined by various factors such as engine speed, intake air flow rate and so forth. In consequence, there is a time lag of detection of the air fuel ratio by the exhaust gas sensor after the formation of the mixture. This constitutes one of the reasons of disturbance of stability of the control system. Therefore, in the conventional system of the kind described, a proportional integrating control in which proportional control and integrating control are combined is adopted to ensure the stability and responsive characteristic of the control system.

In a system incorporating a step motor as the actuator, a clock signal of high speed is delivered to the driving circuit of the step motor only for a predetermined time after the inversion of the output signal from the oxygen sensor, thereby to drive the motor at a high speed to obtain a step operation to achieve the proportional integrating control. In this case, it is necessary to prepare two kinds of clock signal, i.e. a low speed clock of several to several tens of Hertz for integrating control and a clock of several tens to several hundreds of Hertz for skipping operation at a comparatively high speed, and to switch the clock at each time of inversion of the oxygen sensor signal to send the same to the driving circuit. In some cases, two or more clocks of different frequencies are used for the integrating action, due to difference in factors such as rate of air intaking into the engine, engine speed and the amount of change of engine speed. If these clock signals have to be obtained by a demultiplication of the output from a single oscillator, it is necessary to make the oscillator have a considerably high frequency and, in addition, a multiplicity of demultipliers is required which impractically complicates the device. To avoid this, it is a common measure to use two or more independent demultipliers and to switch the output from these demultipliers by means of a gate.

FIG. 2 shows an example of a conventional control circuit. In this control circuit, a high speed clock signal is produced by a circuit including inverters 950,951, resistors R17 and R18, and a capacitor C15, while a low speed clock signal is formed by a circuit including inverters 952,953, resistors R19,R20 and a capacitor C16. A switching between the high speed clock signal and the low speed clock signal is made by the output from a monostable multivibrator which acts at each time of inversion of the signal from the oxygen sensor, and the selected clock signal is delivered to a distribution energizing circuit 962. The monostable multivibrator includes NOR 958, capacitor C14, resistor R16 and an inverter 956. In this state, signals are formed at every part of the circuit as shown in FIG. 3. When the output from the oxygen sensor is changed to invert the direction of control, the clock is switched to the high-speed clock signal for skipping. At this time, there is a possibility that clock of very short period is formed depending on the timing. In this case, it is not possible to obtain the correct operation because the step motor cannot correctly respond. Thus, there is a fear that the required amount of skip cannot be achieved or the inversion is failed to permit the movement in the direction opposite to the desired direction. In addition, when the signal from the oxygen sensor is changed to cause an inversion during the high-speed skipping, an overshoot is caused due to the inertia of the rotor or the like reason resulting in a response failure even though the frequency is within the region of the self-starting frequency. An example of such a mal-functioning is shown by a broken-line arrow in the diagram of the step motor operation in FIG. 3. If the step motor fails to execute the predetermined task, it is quite difficult to achieve the precise air-fuel ratio control, so that the air-fuel ratio of the mixture undesirably comes out of the range suitable for the effective functioning of the catalyst to permit the nonxious exhaust gas components to be released to the atmosphere without being treated.

SUMMARY OF THE INVENTION

Accordingly, an object of the invention is to provide an air-fuel ratio control device which can eliminate or overcome the above-described problems of the prior art.

To this end, according to the invention, there is provided an air-fuel ratio control device in which the motor is temporarily stopped at each time of switching of moving speed or moving direction before the new motion is commenced, thereby to ensure the correct operation of the step motor and, hence, to achieve precise control of the air-fuel ratio.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
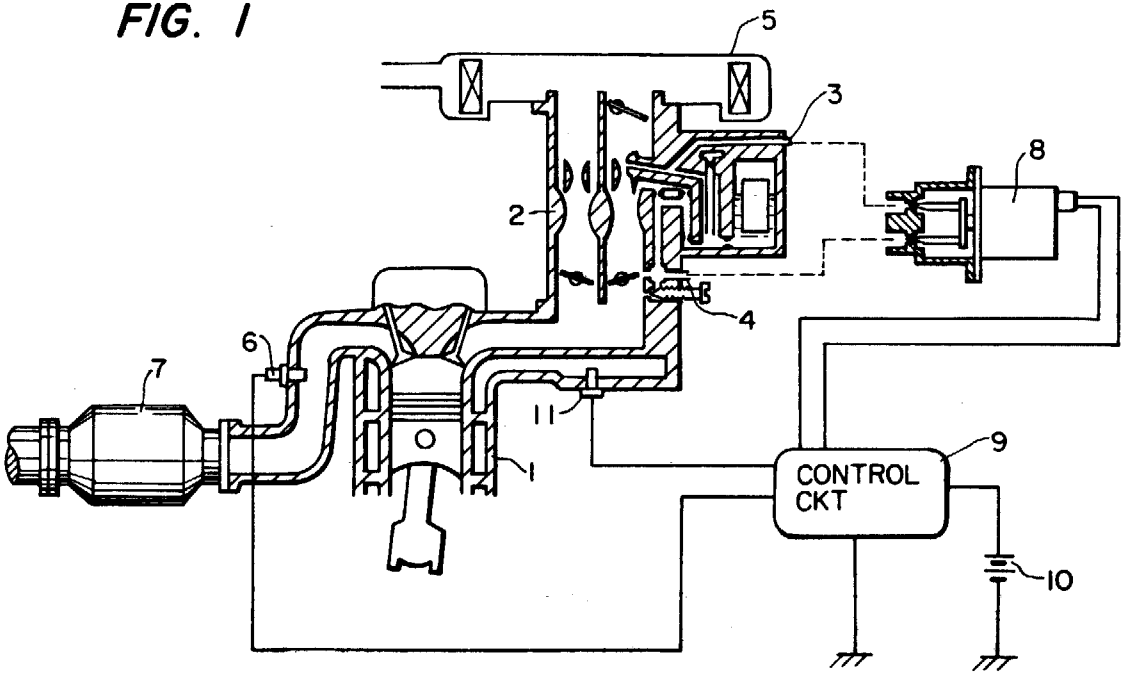
FIG. 1 is a partial vertical sectional view of the whole part of an air-fuel ratio control system.
Figure 2:
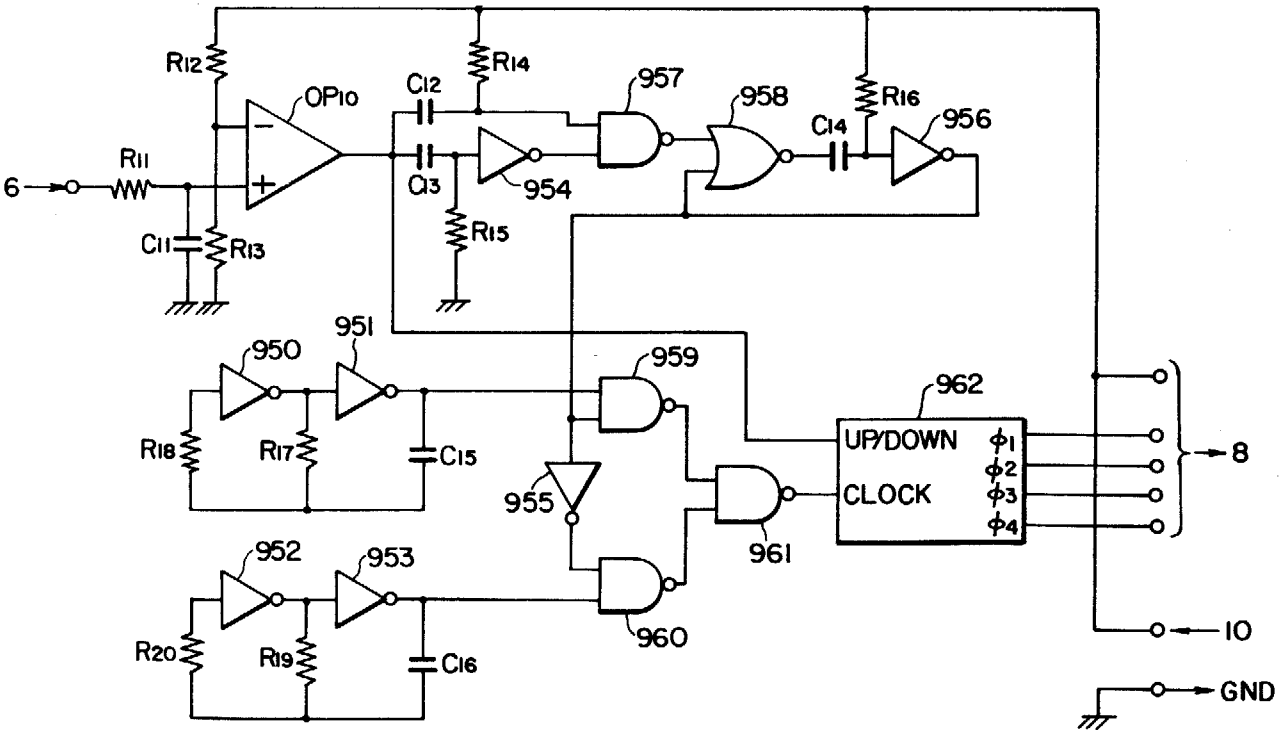
FIG. 2 shows a conventional control circuit.
Figure 3:
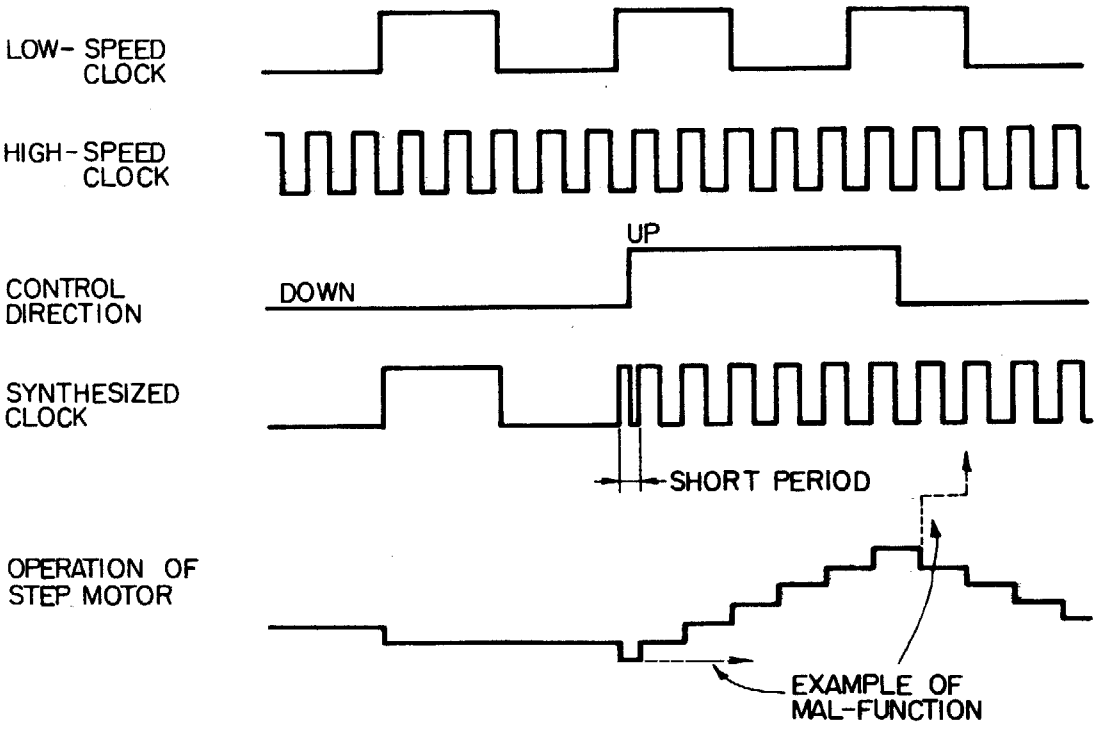
FIG. 3 is a diagram showing the waveforms of signals formed at every parts of the conventional circuit, as well as the operation of a step motor.
Figure 4:
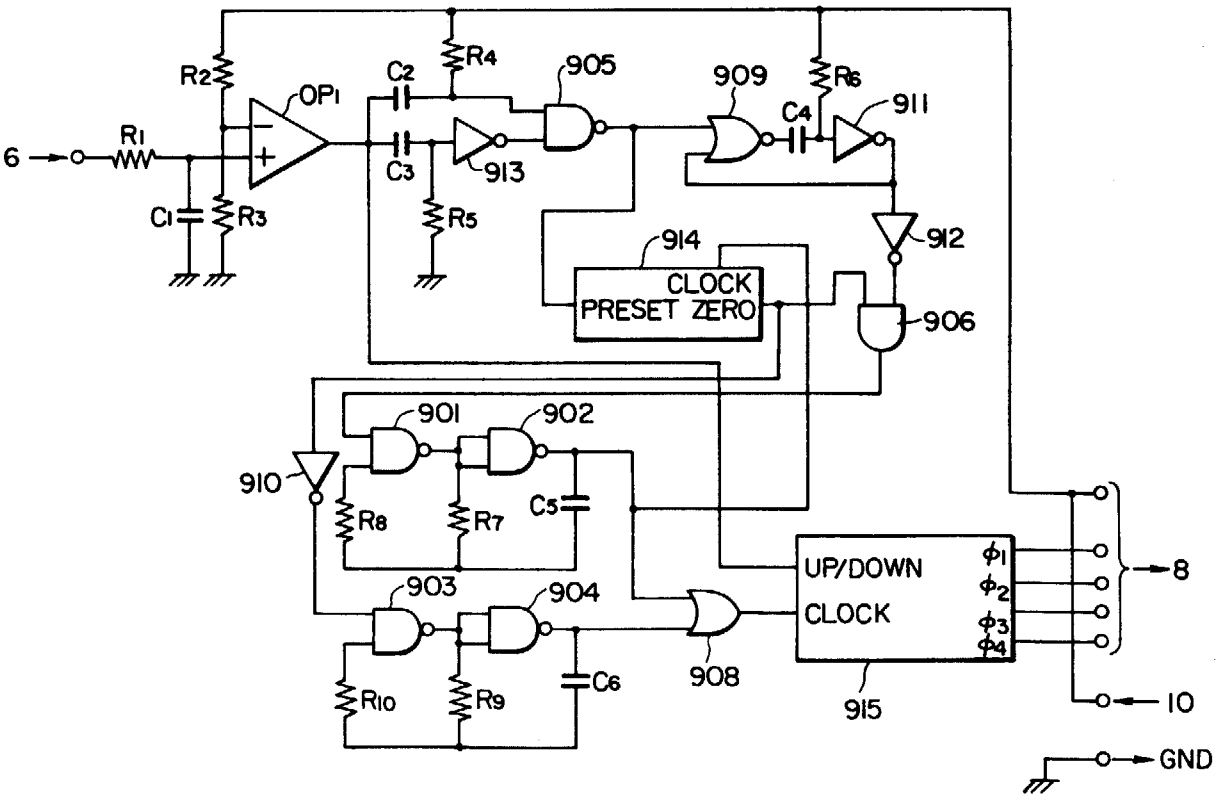
FIG. 4 shows a control circuit constructed in accordance with an embodiment of the invention.

FIG. 4 shows an embodiment of a control circuit 9 suitable for use in the air-fuel ratio control device of the invention. A rich-lean judging circuit is constituted by an operation amplifier OP1, resistors R1,R2,R3 and a capacitor C1. Resistors R4, R5, capacitors C2,C3, NAND gate 905, inverter 913 and a counter 914 constitutes a circuit for determining the skipping amount. A monostable multivibrator includes a resistor R6, capacitor C4, NOR gate 909 and an inverter 911. Resistors R7,R8, capacitor C5 and NAND gates 901,902 constitute a high-speed clock oscillator 1, while a low-speed clock oscillator 2 is composed of resistors R9,R10, capacitor C6 and NAND gates 903,904.

Reference numerals 910, and 912 denote inverters, 906 denotes an AND gate and 908 denotes an OR circuit. Also, an oxygen sensor is designated at a reference numeral 6, while an actuator designated at a reference numeral 8 is connected to the step motor. A battery is designated at a reference numeral 10. GND represents the grounding. The oxygen sensor 6 disposed at the upstream side of a tertiary catalyst 7 is adapted to detect the concentration of oxygen in the exhaust gas emitted from an engine 1, and delivers the detection output to a control circuit 9.

The control circuit 9 is adapted to compare this detection output with a reference voltage which represents the predetermined command air-fuel ratio thereby to judge whether the actual air-fuel ratio is greater or smaller than the command air-fuel ratio. In case that the mixture is richer than the mixture of the command air-fuel ratio, the control circuit 9 provides a signal to drive the actuator in the direction for increasing the control air bleed, whereas, when the mixture is leaner, the control circuit 9 delivers a signal for driving the actuator in the direction for reducing the control bleed air. In consequence, the fuel supplied from the carburetor 2 is metered and adjusted to make the actual air-fuel ratio coincide with the command air-fuel ratio.

The signal from the oxygen sensor 6 is compared with the reference voltage corresponding to the desired command air-fuel ratio applied to the minus input of the operation amplifier OP1 so that a judgement is made as to whether the actual mixture is richer or leaner than the command mixture. At each time of inversion between the rich and lean, a positive trigger signal is generated at the output of the NAND gate 905 shown in FIG. 4.

By this signal, the counter 914 is set at a value required as the skipping amount. This signal is delivered also to the NOR gate 909, so that the monostable multivibrator is operated to keep the output from the inverter 912 at the "L" level after the inputting of the trigger signal for a predetermined time length which is determined by the capacitance of the capacitor C4 and the resistance of the resistor R6. It is arranged such that the ZERO output of the counter 914 takes the "H" level when the content of the counter takes a value other than zero. Thus, the output from the AND gate 906 is changed to "H" level after elapse of a predetermined time from the moment of inversion of the output from the $O_2$ sensor. This signal is delivered to the NAND gate 901 while the zero output from the counter 914 is delivered to the NAND gate 903 through the inverter 910. When the ZERO output takes the "L" level, the NAND gate 901 receives a signal of the "L". In this state, since the output from the NAND gate 902 takes the "L" level while the NAND gate 903 receives the signal of "H" level, the clock oscillator 2 starts to operate so that the output from the NAND gate 904 alternatingly and repeatedly takes the "H" and "L" levels. In this state, the step motor is driven at a low speed by the clock signal from the clock oscillator 2.

As the ZERO output of the counter 914 comes take the "H" level, a signal of "L" level is inputted to the NAND gate 903, so that the output from the clock oscillator 2 is stopped at the "L" level. On the other hand, as the output of the AND gate 906 takes the "H" level after elapse of a predetermined time, the clock oscillator 1 starts to operate and the counter 914 starts to make a down count. Simultaneously, the step motor is driven at the high-speed clock signal from the clock oscillator 1 and turns into the skipping operation. When the counter 914 has just counted the preset value, the ZERO output terminal takes the "L" level so that the NAND gate 901 receives the signal of the "L" level through the AND gate 906. In consequence, the clock oscillator 1 is stopped at the "L" level. Simultaneously, the input terminal of the NAND gate 903 takes the "H" level, so that the clock oscillator starts to operate to permit the step motor to commence the integrating operation.

Thus, in the air-fuel control device of the invention, the clock delivered to the distribution circuit 915 is temporarily stopped before it is turned to the high-speed clock for the skipping, at each time of inversion of the output of the oxygen sensor from the rich side to the lean side and vice versa, and, after the completion of the skipping, the high-speed clock is substituted by the low-speed clock starting from the normal rise.

Figure 5:
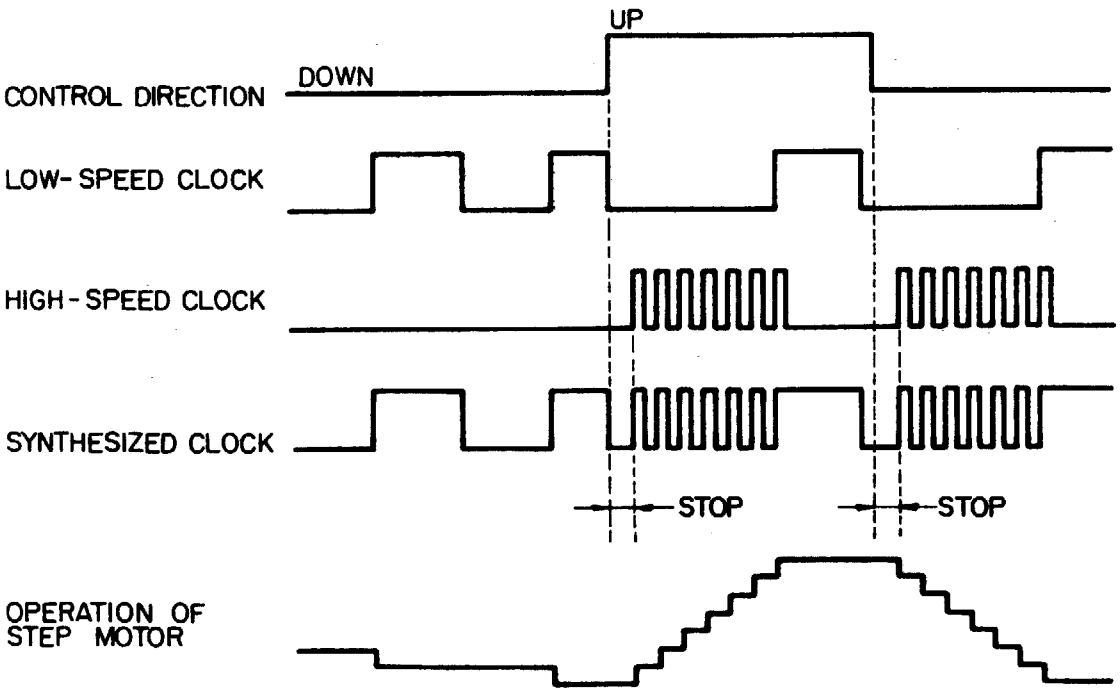
FIG. 5 is a diagram showing the waveforms of signals formed at every parts of the circuit in accordance with the invention, as well as the operation of a step motor.

This operation of the step motor will be more clearly understood from FIG. 5. It will be seen from this Figure that the step motor is temporarily stopped for a predetermined time length before the stepping speed or the direction of rotation of the step motor is changed.

Figure 6:
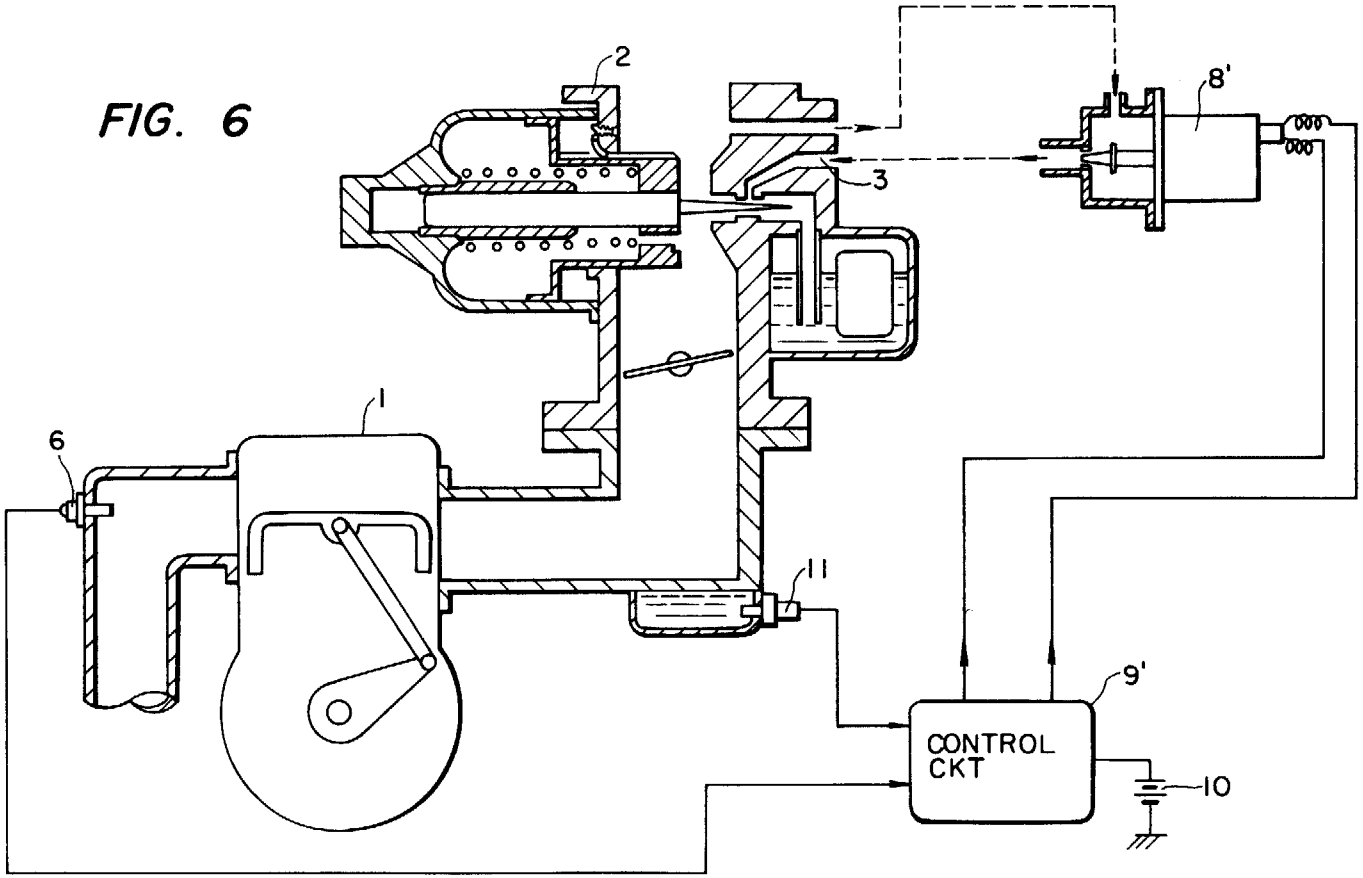
FIGS. 6 and 7 are partial vertical sectional views of different embodiments.

FIG. 6 shows another embodiment applied to an air intake system having a venturi type carburetor. A reference numeral 8' designates an actuator for adjusting the opening area of the air bleed passage, 9' designates a control circuit having a function to temporarily stop the step motor and incorporated by the actuator 9'. A water temperature sensor 11 is adapted to determine the condition of commencement of the air-fuel ratio control performed by the oxygen sensor 6.

Figure 7:
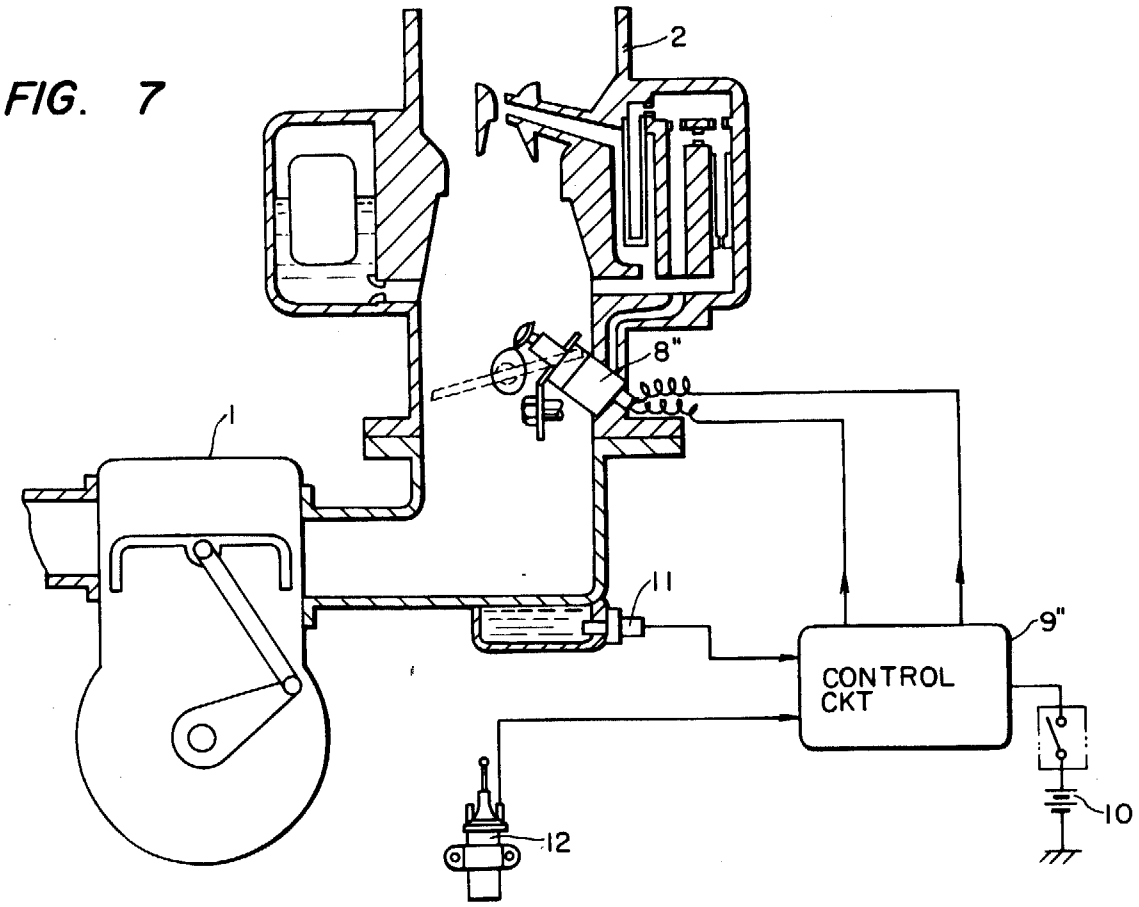

FIG. 7 shows still another embodiment in which a control circuit 9" detects the engine speed upon receipt of a triggering signal from the ignition coil 12, and compares the engine speed with the command speed to produce a control signal to be delivered to the actuator 8" in accordance with the deviation of the engine speed. The actuator 8" then adjusts the opening degree of the carburetor to maintain the desired engine speed. The temperature water sensor 11 is adapted to produce a signal representing the state of warming up of the engine. The command engine speed is determined by the control circuit 9".

As has been described, in the air-fuel ratio control device of the invention, the clock is temporarily stopped for a predetermined time length at each time of inversion of the signal from the oxygen sensor. Therefore, there is no possiblity of production of the clock of such a short period as to make the step motor fail to respond, at whichever timing the inversion signal may be inputted, to turn to the skipping operation only after the inversion of direction. In addition, the inversion can be achieved to avoid malfunctioning to ensure a precise air-fuel ratio control because the step motor is temporarily stopped without fail even when an inversion signal is received during the high-speed skipping operation.

This effect is remarkable particularly in such a control circuit having a circuit for memorizing the control position of the step motor, because, in such a control circuit, the actual position and the memorized position are offset from each other to make it impossible to grasp the control position. In such a case, the actuator is controlled at a position different from the expected position to cause an excessive enrichment and leaning of the air-fuel ratio to deteriorate the engine performance or to permit the release of a large amount of nonxious exhaust gas components to the atmosphere.

This problem is completely overcome by the present invention because no clock which would make unable the step motor to respond is produced, to ensure the correct operation of the air-fuel control device.

What is claimed is:

1. An air-fuel ratio control device having an exhaust gas sensor disposed in the exhaust system of an internal combustion engine; a control circuit adapted to produce, in accordance with the offset of the output from said exhaust gas sensor from a reference voltage corresponding to the desired air-fuel ratio, a control signal for making the air-fuel ratio of mixture to be supplied to said engine coincide with the command air-fuel ratio; and a mixture supplying means including means for adjusting said air-fuel ratio of said mixture in accordance with said control signal; wherein the improvement comprises that said means for adjusting the air-fuel ratio includes an actuator incorporating a step motor adapted to change the opening area of fuel passage of a carburetor or an air bleed passage of said carburetor; and that said control circuit has means for temporarily stopping said step motor for a predetermined time length before the stepping speed or the stepping direction of said step motor is changed.

2. The device according to claim 1, wherein said step motor is driven by clock signals provided by said control circuit, and wherein said stopping of said step motor is accomplished by a suspension of a supply of said clock signals for said predetermined period of time.

3. The device according to claim 1, wherein said control circuit includes means for generating clock pulses at a first frequency and at a second frequency, means for selectively coupling said clock pulses at said first frequency and said clock pulses at said second frequency to said step motor for driving said step motor, and means connected to said generating means and said coupling means for inhibiting the generation of a clock pulse at said first frequency during a transition between clock pulses at said first and said second frequency by said coupling means.

4. The device according to claim 3, wherein the clock pulses at said first frequency are at a higher pulse repetition frequency than the clock pulses at said second frequency.

5. The device according to claim 4, further comprising distribution means connected between said generating means and said motor for selectively coupling clock pulse signals to specific terminals of said motor for selecting a direction of stepping of said motor.

6. The device according to claim 5, wherein said means for inhibiting the generation of said clock pulse at said first frequency is operative during a transition in the direction of stepping of said motor.

7. A system for controlling the air-fuel ratio of an engine, comprising mixing means for mixing fuel and air in a predetermined ratio, a stepping motor for operating said mixing means to select said air-fuel ratio, a drive circuit for driving said motor in response to an ignition of combustion of said engine, and wherein said drive circuit comprises a source of clock pulse signals for energizing said motor, means for selecting one or another frequency of said clock pulse signals, and means for inhibiting the application of said another frequency clock pulse signals to said motor during a transition in the frequency of said clock pulse signal from said one frequency to said another frequency.

8. The system according to claim 7, wherein said drive circuit further comprises means for distributing said clock pulse signals to said motor for a selection of direction of stepping of said motor, and wherein said inhibiting means is operative at the time of changing of direction of stepping of said motor for inhibiting the application of a pulse of said clock pulse signal to said motor during a change in direction of stepping thereof.

* * * * *